US011618649B2

(12) United States Patent
Puranen et al.

(10) Patent No.: US 11,618,649 B2
(45) Date of Patent: Apr. 4, 2023

(54) ELEVATOR APPARATUS

(71) Applicant: Kone Corporation, Helsinki (FI)

(72) Inventors: Mikko Puranen, Helsinki (FI); Mari Zakrzewski, Helsinki (FI)

(73) Assignee: Kone Corporation, Helsinki (FI)

( * ) Notice: Subject to any disclaimer, the term of this patent is extended or adjusted under 35 U.S.C. 154(b) by 483 days.

(21) Appl. No.: 16/776,643

(22) Filed: Jan. 30, 2020

(65) Prior Publication Data

US 2020/0299101 A1 Sep. 24, 2020

(30) Foreign Application Priority Data

Mar. 19, 2019 (EP) ..... 19163634

(51) Int. Cl.

| | |
|---|---|
| ***B66B 5/00*** | (2006.01) |
| ***B66B 1/30*** | (2006.01) |
| ***B66B 5/02*** | (2006.01) |
| ***B66B 9/00*** | (2006.01) |

(52) U.S. Cl.

CPC ..... *B66B 5/0031* (2013.01); *B66B 1/30* (2013.01); *B66B 5/02* (2013.01); *B66B 9/00* (2013.01)

(58) Field of Classification Search

CPC ..... B66B 5/0031; B66B 1/30; B66B 5/02; B66B 9/00

See application file for complete search history.

(56) References Cited

U.S. PATENT DOCUMENTS

| | | | | |
|---|---|---|---|---|
| 4,117,908 | A * | 10/1978 | Nara | B66B 7/06 187/254 |
| 5,861,084 | A * | 1/1999 | Barker | B66B 7/06 187/414 |
| 8,123,002 | B2 * | 2/2012 | Smith | B66B 7/068 187/266 |
| 9,327,942 | B2 * | 5/2016 | Fukui | B66B 5/022 |
| 9,359,172 | B2 * | 6/2016 | Mangini | B66B 7/06 |
| 9,676,592 | B2 * | 6/2017 | Wells | B66B 5/0031 |
| 11,325,812 | B2 * | 5/2022 | Sato | B66B 7/06 |
| 2013/0048438 | A1 * | 2/2013 | Mangini | B66B 7/06 187/414 |
| 2013/0133983 | A1 * | 5/2013 | Mangini | B66B 5/021 187/277 |
| 2014/0000985 | A1 * | 1/2014 | Fukui | B66B 5/022 187/247 |
| 2014/0124300 | A1 * | 5/2014 | Benosman | B66B 7/06 187/247 |

(Continued)

FOREIGN PATENT DOCUMENTS

DE 102006027989 A1 * 12/2007 ..... B66B 7/066

*Primary Examiner* — Michael A Riegelman
(74) *Attorney, Agent, or Firm* — Harness, Dickey & Pierce, P.L.C.

(57) ABSTRACT

The invention relates to an elevator apparatus, comprising: a shaft, an elevator car vertically movable in the shaft, one or more ropes connected with the car, and a controller for controlling movement of the car. In order to detect sway in one or more elevator ropes connected with the car, the apparatus comprises at least one sensor unit arranged in the elevator shaft to detect sway and to produce a control signal indicating to the controller the detected sway. The controller compares the detected sway to a predetermined limit and prevents movement of the elevator car when sway reaches the predetermined limit.

18 Claims, 4 Drawing Sheets

(56) References Cited

U.S. PATENT DOCUMENTS

| | | | | |
|---|---|---|---|---|
| 2014/0229011 | A1* | 8/2014 | Fukui | G05B 15/02 700/275 |
| 2015/0008075 | A1* | 1/2015 | Benosman | B66B 7/06 187/247 |
| 2015/0027814 | A1* | 1/2015 | Benosman | B66B 5/02 187/247 |
| 2016/0145074 | A1* | 5/2016 | Kattainen | B66B 5/022 187/254 |
| 2016/0376125 | A1* | 12/2016 | Wells | B66B 7/06 187/266 |
| 2018/0305176 | A1* | 10/2018 | Miyajima | G01S 17/58 |
| 2020/0299101 | A1* | 9/2020 | Puranen | B66B 7/10 |
| 2021/0206597 | A1* | 7/2021 | Kalliomaki | B66B 5/02 |
| 2021/0206600 | A1* | 7/2021 | Kalliomaki | B66B 7/06 |
| 2021/0221645 | A1* | 7/2021 | Kwon | B66B 9/00 |
| 2021/0331896 | A1* | 10/2021 | Kwon | B66B 1/04 |

* cited by examiner

ELEVATOR APPARATUS

RELATED APPLICATIONS

This application claims priority to European Patent Application No. 19163634.9 filed on Mar. 19, 2019, the entire contents of which are incorporated herein by reference.

FIELD OF THE INVENTION

This invention relates to an elevator apparatus and more particularly to detecting rope sway in the elevator shaft.

BACKGROUND OF THE INVENTION

One of the problems associated with high rise buildings is wind induced building sway which may cause difficulties for elevator systems. The natural frequency of the building is typically close to that of elevator suspension ropes or compensation ropes, at least if the elevator car is on a certain floor. This makes also the ropes sway, which in all cases reduce ride comfort and in severe cases ropes may hit and damage the shaft equipment or even doors.

To prevent damage caused by rope sway, elevator speed must be lowered or completely stopped until sway dampens. Elevator apparatuses are set out of service for certain time, until sway is reduced to an acceptable level.

A drawback with such solution is that it leads to unnecessary reductions in elevator service level. Many other factors have a significant effect on actual rope sway, which are not considered. The sway performance of a single elevator apparatus is difficult to optimize, instead the whole elevator group is stopped at the same time in case of building sway.

BRIEF DESCRIPTION OF THE INVENTION

An object of the present invention is to solve the above-mentioned drawback and to provide a solution which can be used to determine when it is safe to utilize an elevator apparatus during the sway of the building. This object is achieved with an elevator apparatus according to independent claim 1.

A sensor unit is arranged in the elevator shaft and it detects sway in the one or more ropes and produces a control signal which indicates to a controller the detected sway. The actual rope sway can be directly detected, and the elevator car movement can be controlled accordingly from the controller.

Preferred embodiments of the invention are disclosed in the dependent claims.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
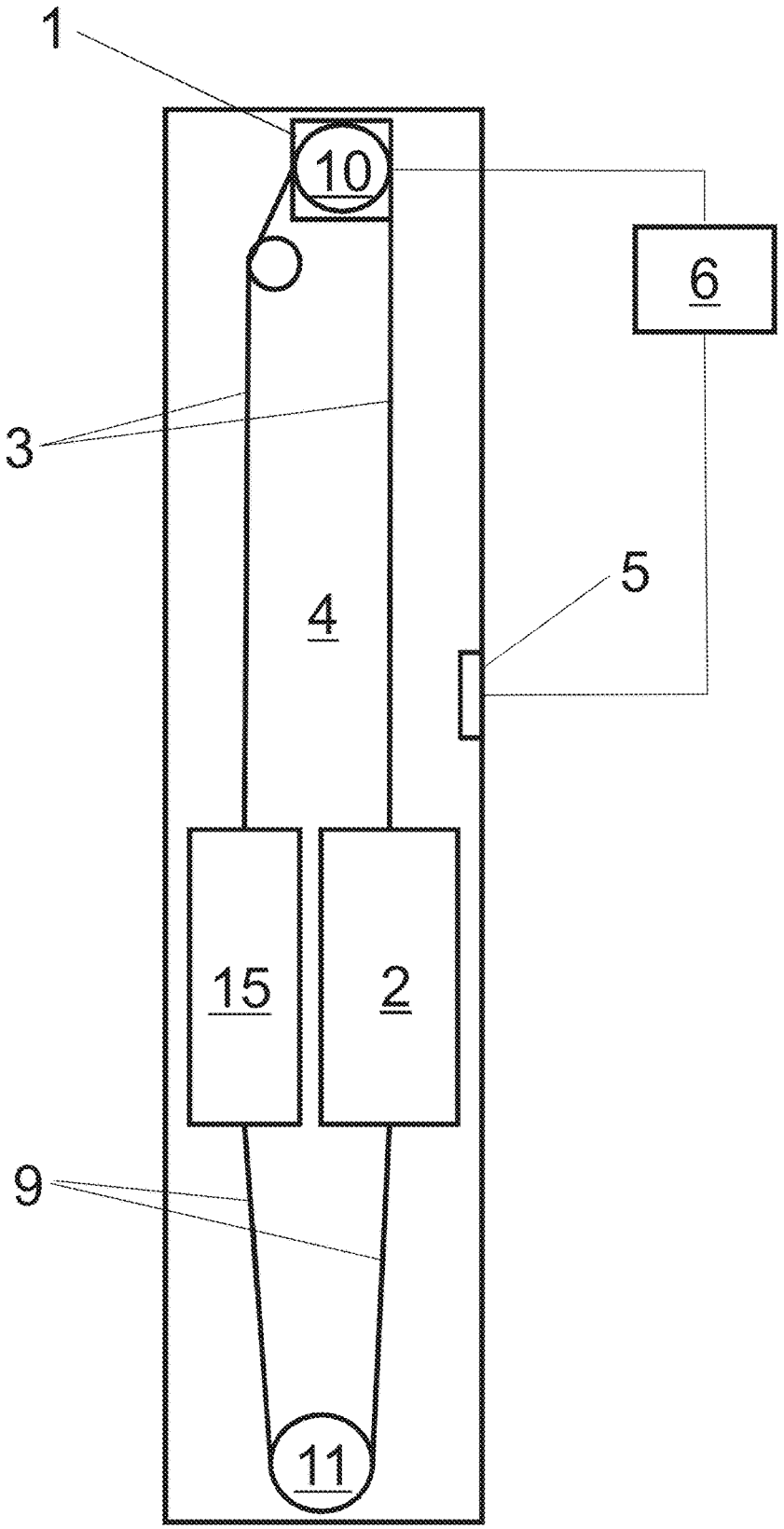
FIG. 1 illustrates a side view of an elevator apparatus.

FIG. 1 illustrates an example of a side view of an elevator apparatus and comprises an elevator shaft 4 and an elevator car 2 which is arranged to move vertically in the shaft 4. A drive unit 1 is connected with the elevator car 2 via one or more ropes 3, which are suspension ropes for suspending the car and also a counterweight (15).

FIG. 1 has by way of example been simplified to show that the drive unit 1 comprises an electric motor and a drive sheave 10. The electric motor is arranged to rotate the drive sheave 10 engaging the suspension ropes 3 connected to the car 2. The illustrated elevator apparatus is provided with at least one compensation rope 9 hanging between the elevator car 2 and counterweight 15 and passing around a compensation sheave 11 mounted at the lower end of the shaft 4. In this embodiment, roping ratio 1:1 is used. At least one sensor unit 5 is arranged in the elevator shaft 4 and is in communication with a controller 6.

In this example, the sensor unit 5 comprises at least one sensor which uses radar to detect sway amplitude, though other type of sensors could be used. The radar sensor uses electromagnetic radiation to detect the location and distance of an object by monitoring the reflection from said object. For this purpose, the radar sensor is preferably arranged to send electromagnetic radiation towards the one or more ropes 3, 9 and to receive reflections of said radiation reflected from said one or more ropes. The radar sensors operate typically in the ultra-high frequency and microwave range. The sensor unit 5 is situated inside the shaft 4, preferably within the central third section of vertical height, where it can detect the rope sway.

In the illustrated example, the sensor unit 5 is arranged to detect rope sway of both suspension ropes 3 and compensation ropes 9. However, in other installations it may be sufficient to detect rope sway of one of the ropes 3, 9 only, for instance.

The controller 6 is connected to the sensor outputs for receiving control signals to controller hardware. The output signals can be received cordlessly or with a cord. The controller 6 additionally controls the drive unit 1, which is arranged to move the elevator car 2 in the elevator shaft 4. The controller 6 can be part of control complex which controls and supervises all operations of the elevator system including several elevator cars.

In the illustrated example, the sensor unit 5 is situated in the middle section of the elevator shaft 4. A very basic and cost-effective Doppler radar sensor can be used in this embodiment. The Doppler radar sensor has the advantage of being an extremely sensitive and reliable movement sensor which is possible to sense important characteristics of sway directly. With Doppler radar, sway amplitude can be calculated by detecting frequency shift or phase shift. The former is relative to rope velocity and the latter indicates the distance shift between the one or more ropes 3, 9 and the radar. The calculation can be carried out in the sensor unit 5 or alternatively in the controller 6.

A Frequency-Modulated Continuous-Wave (FMCW) or an Ultra-Wide Band (UWB) radar sensor can also be used in this embodiment instead of the Doppler radar. The FMCW radar is preferably arranged to send out linearly modulated electromagnetic wave of constant frequency and determine the distance between the sensor and an object based on the difference in transmitted and received frequency. A typical UWB radar is an electromagnetic pulse radar which is arranged to transmit much wider frequency than conventional radar systems. The most common technique for generating a UWB signal is to transmit pulses at specific time intervals. Distances can be measured to high resolution and accuracy which is one of the main advantages in using the UWB radars.

The frequency information can be used to extract the rope movement force in typical rope sway frequency bands, and the rope sway existence and intensity can be calculated. The phase shift information can be used to extract the relative or absolute rope movement amplitude radial to the radar sensor.

In the example of FIG. 1, only one sensor unit 5 detecting sway in one dimension is utilised. Alternatively, one single sensor unit 5 capable of detecting sway in two dimensions may be utilised.

Figure 2:
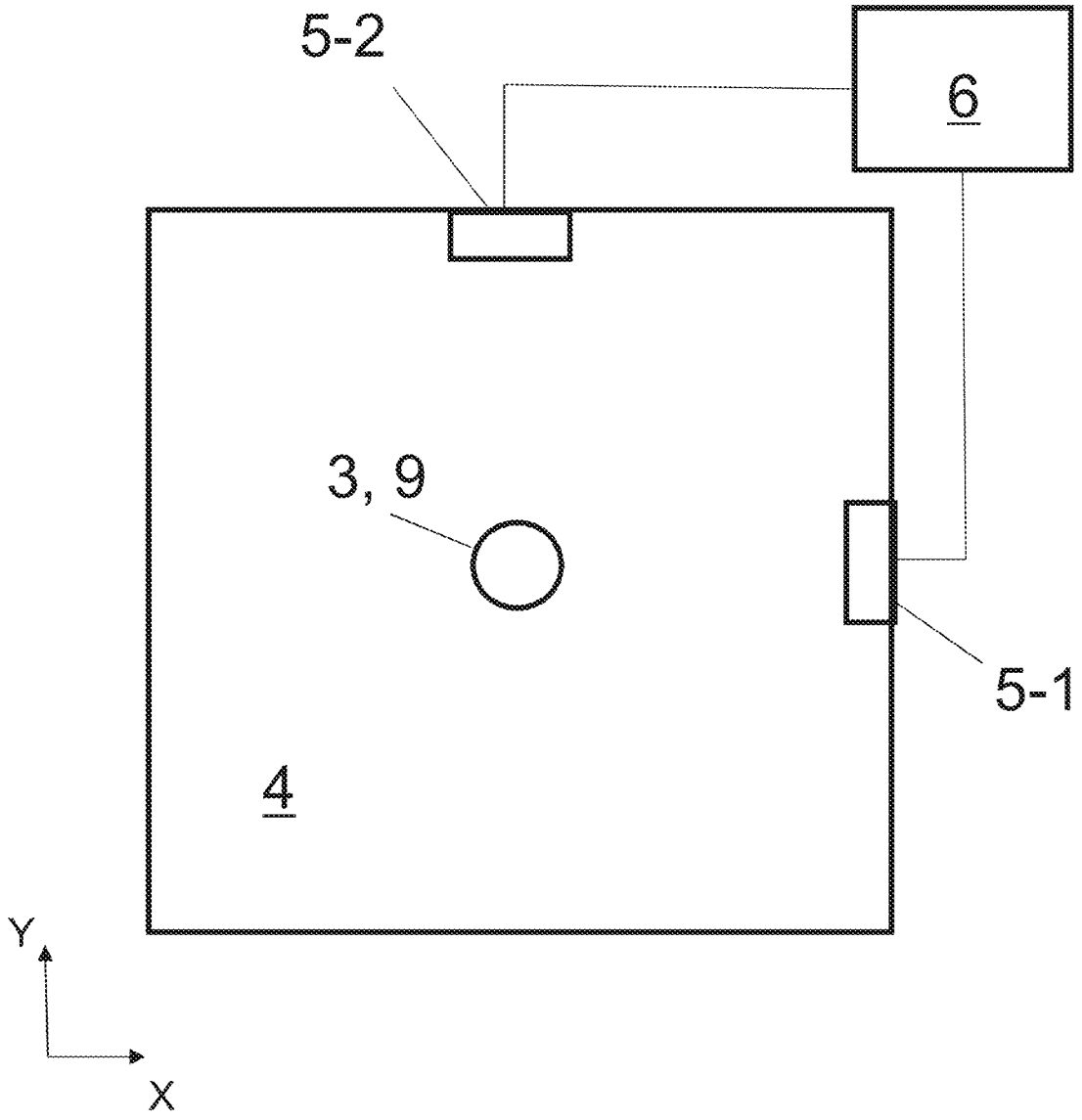
FIG. 2 illustrates a cross sectional view of the elevator shaft from above in a second embodiment.

FIG. 2 illustrates a cross sectional view of the elevator shaft 4 from above in a second embodiment. The embodiment of FIG. 2 is very similar to the one explained in connection with FIG. 1. Therefore, the embodiment of FIG. 2 is in the following mainly explained by pointing out differences.

In FIG. 2, a sensor unit 5 comprising two separate sensors are used in the elevator shaft 4 to detect the movements in both horizontal X-direction and horizontal Y-direction. FIG. 2 illustrates an example of a cross sectional view of the elevator shaft 4 from above. Sensor 5-1 is fixed on the shaft wall in perpendicular line with the one or more elevator ropes 3, 9 and detects the horizontal rope sway in X-direction and sensor 5-2 is fixed on the adjacent shaft wall in perpendicular line with the one or more elevator ropes 3, 9 and detects the horizontal rope sway in Y-direction. However, multiple sensor units can be fixed in the same elevator shaft 4 at different heights for optimizing rope sway detection.

The received information can be combined to construct the 2-dimensional sway movements. Modern amplitude extraction methods can be used to extract very accurate amplitude information with sub-millimetre accuracy.

The controller 6 is configured to compare the detected sway to a first predetermined limit. If the first limit is reached, it will send a control signal to the drive unit 1 to slow down or stop the elevator car 2 completely. When the detected sway is dampened below the first predetermined limit, the controller 6 is configured to send additional control signal to the drive unit 1 to accelerate or start up the elevator car 2.

The predetermined limit can also be changeable, wirelessly or with a wire, using a data transfer interface in communication with the controller 6. The data transfer interface can be a control unit or part of the control complex in a security control room of the building, for instance. In case a damage or malfunction has been caused by rope sway to nearby elevator apparatuses, the predetermined limit can be lowered to avoid a risk of damaging the elevator apparatus in this example.

Figure 3:
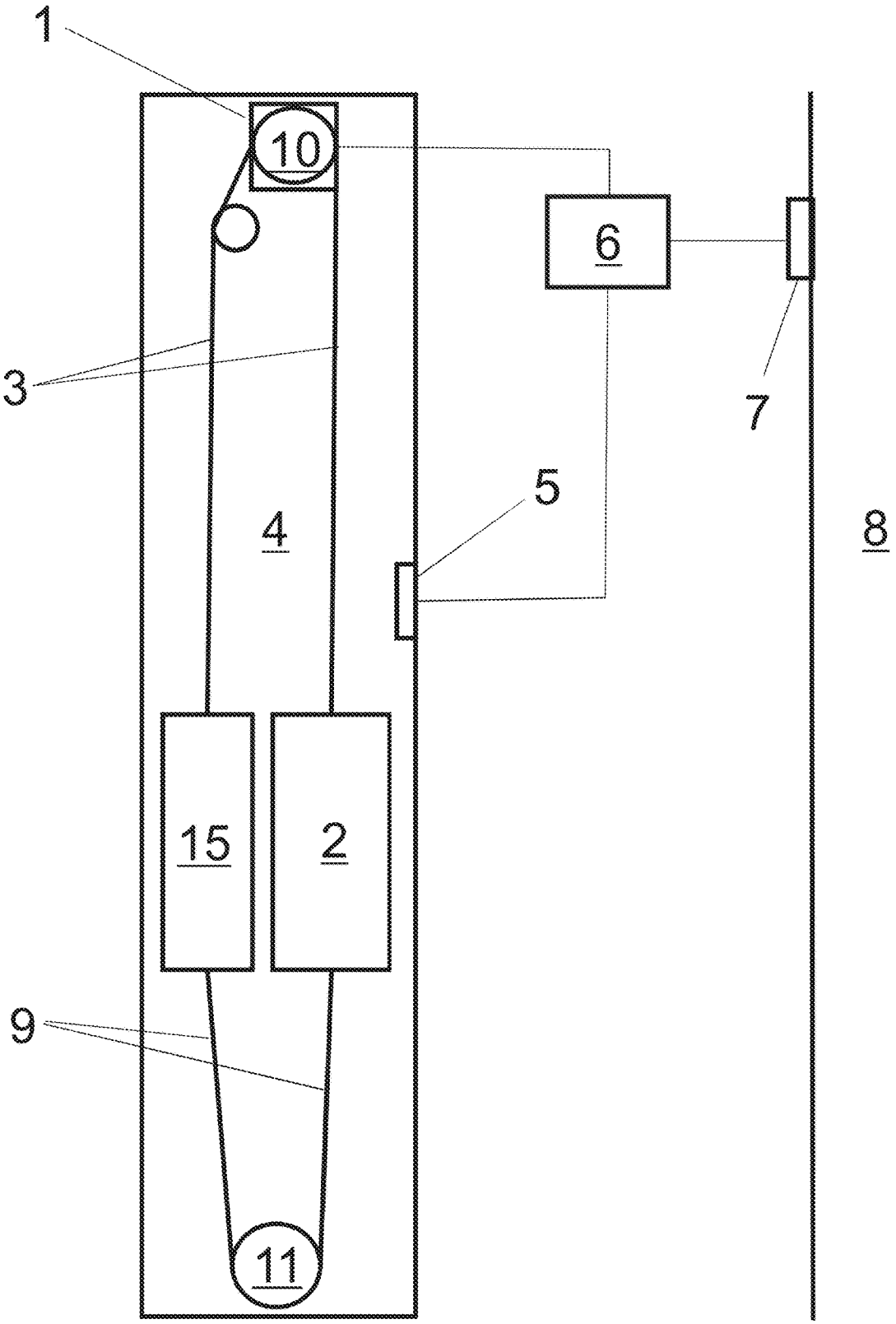
FIG. 3 illustrates a side view of a third embodiment of the elevator apparatus.

FIG. 3 illustrates a side view of a third embodiment of the elevator apparatus. The embodiment of FIG. 3 is very similar to the one explained in connection with FIG. 1. Therefore, the embodiment of FIG. 3 is in the following mainly explained by pointing out differences.

FIG. 3 illustrates an example of another embodiment of the invention with a side view of the elevator apparatus which comprises a second sensor unit 7 attached to a fixed part 8 of a building to detect sway of the building. In this connection the term fixed part 8 of a building refers to a wall, floor or any other structural part of the building which does not move with the elevator car 2. Preferably, although not necessarily, the second sensor unit 7 comprises one or more acceleration sensors or one or more gyroscope sensors. The second sensor unit 7 produces a second control signal output, cordlessly or with a cord, indicating to the controller 6 the detected building sway.

The acceleration sensor or the gyroscope sensor are used to detect the absolute movement of the building sway. The controller 6 compares and combines the signals from all sensors to increase the accuracy of the absolute rope sway measurement. In a case where the building sway exceeds a second predetermined limit but the rope sway in the shaft 4 is lower than the first predetermined limit, the controller 6 is configured to compare the absolute rope sway to a third predetermined limit. If the third limit is reached, it will send a control signal to the drive unit 1 to slow down or stop the elevator car 2 completely. When the absolute rope sway is dampened below the third predetermined limit, the controller 6 is configured to send additional control signal to the drive unit 1 to accelerate or start up the elevator car 2.

Figure 4:
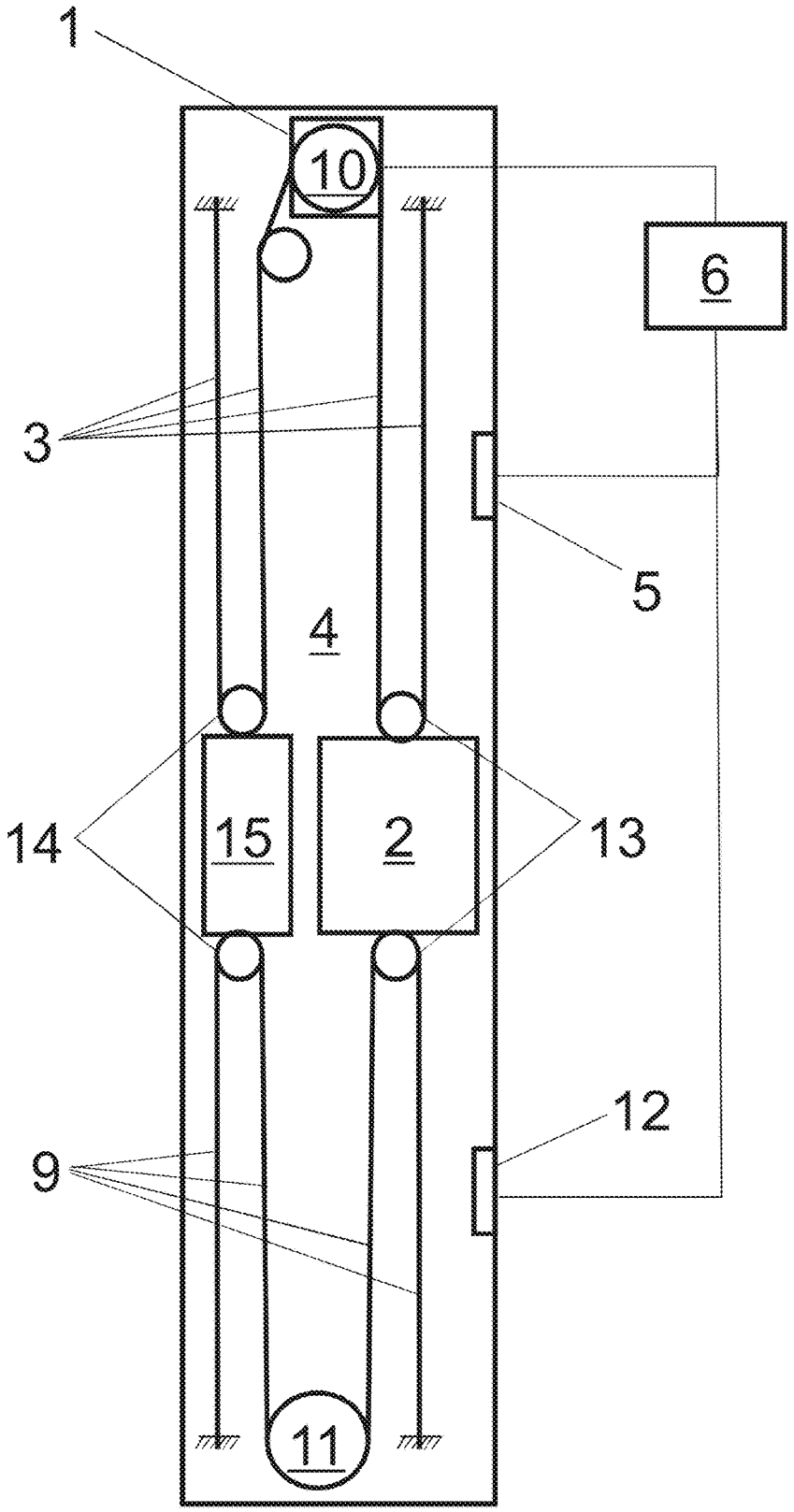
FIG. 4 illustrates a side view of a fourth embodiment of the elevator apparatus with 2:1 roping ratio.

FIG. 4 illustrates a side view of a fourth embodiment of the elevator apparatus. The embodiment of FIG. 4 is very similar to the one explained in connection with FIG. 1. Therefore, the embodiment of FIG. 4 is mainly explained by pointing out differences.

In this embodiment, the roping ratio 2:1 and two sensor units 5, 12 are used. The sensor unit 5 detects sway amplitude of the at least one suspension rope 3 at the upper part of the elevator shaft 4 and another sensor unit 12 detects sway amplitude of the at least one compensation rope 9 at the lower part of the elevator shaft 4 in the illustrated situation.

With roping ratio 2:1, the elevator car speed is reduced to half of the rope speed and both ends of the suspension rope 3 are attached to a stationary structure of building such as top beam in the elevator shaft 4 and both ends of the compensation rope 9 are attached to the bottom beam in the elevator shaft 4. Car sheaves 13 and counterweight sheaves 14 are attached to above and under the elevator car 2 and the counterweight 15, respectively. Other roping ratios in different elevator systems can also be applied with the solution according to the independent claim 1.

With the embodiments of FIGS. 1-4, each elevator apparatus of each shaft can be controlled individually during a building sway. Multiple elevator apparatuses are usually installed in a same building. If the rope sway of only one single elevator apparatus reaches the first predetermined limit, the controller 6 will send a control signal to the drive unit 1 of said elevator apparatus to slow down or stop completely, but the rest of the elevator apparatuses can operate normally. With this solution, some elevator apparatuses can be kept operational even in severe storms and the elevator service level won't have unnecessary reductions.

It will be obvious to a person skilled in the art that, as the technology advances, the inventive concept can be implemented in various ways. The invention and its embodiments are not limited to the examples described above but may vary within the scope of the claims.

The invention claimed is:

1. An elevator apparatus, comprising:

a shaft, an elevator car vertically movable in the shaft, a radar sensor in the shaft, a plurality of ropes connected with the elevator car, and a controller configured to control movement of the elevator car, wherein the radar sensor is configured to detect sway in the plurality of ropes connected with the elevator car, and to produce a control signal indicating to the controller the detected sway.

2. The elevator apparatus according to claim 1, wherein the elevator apparatus comprises a drive unit configured to move the elevator car via the plurality of ropes connected with the elevator car, and the controller is configured to control operation of the drive unit.

3. The elevator apparatus according to claim 1, wherein the plurality of ropes connected with the elevator car comprise one or more suspension ropes suspending at least one of the elevator car or a counterweight.

4. The elevator apparatus according to claim 1, wherein the plurality of ropes connected with the elevator car comprise one or more compensation ropes hanging between the elevator car and a counterweight.

5. The elevator apparatus according to claim 1, wherein the radar sensor is configured to detect sway in at least a first horizontal X-direction and a second horizontal Y-direction in the shaft.

6. The elevator apparatus according to claim 1, wherein the radar sensor is configured to send electromagnetic radiation towards the plurality of ropes and to receive reflections of said electromagnetic radiation reflected from the plurality of ropes.

7. The elevator apparatus according to claim 1, wherein the radar sensor is configured to detect at least one of frequency shift or phase shift.

8. The elevator apparatus according to claim 7, wherein at least one of the radar sensor or the controller are further configured to calculate an absolute sway of at least one rope of the plurality of ropes.

9. The elevator apparatus according to claim 1, wherein the controller is configured to compare the detected sway to a first predetermined limit and is further configured to slow down or stop the movement of the elevator car in response to the sway reaching the first predetermined limit.

10. The elevator apparatus according to claim 9, wherein the controller is further configured to accelerate or start up the elevator car in response to the detected sway being dampened below the first predetermined limit.

11. The elevator apparatus according to claim 9, wherein the first predetermined limit is changeable.

12. The elevator apparatus according to claim 1, further comprising at least two radar sensors installed in the shaft in different locations.

13. The elevator apparatus according to claim 1, wherein the radar sensor is at least one of a Doppler radar, a Frequency-Modulated Continuous-Wave sensor, or a Ultra-Wide Band radar.

14. The elevator apparatus according to claim 1, further comprising a second sensor unit attached to a fixed part of a building configured to detect sway of the building and to produce a second control signal to indicate the controller the detected sway of the building.

15. The elevator apparatus according to claim 14, wherein the second sensor unit includes an acceleration sensor or a gyroscope sensor.

16. The elevator apparatus according to claim 15, wherein the second sensor unit is the gyroscope sensor.

17. The elevator apparatus according to claim 14, wherein the controller is configured to compare the sway indicated by the control signal to the sway of the building indicated by the second control signal and is further configured to determine an absolute rope sway.

18. An elevator sway detection system, comprising:

a shaft;

an elevator car vertically movable in the shaft;

a sensor unit in the shaft;

a rope connected with the elevator car; and a controller configured to control movement of the elevator car, wherein the sensor unit is configured to detect sway in the rope connected with the elevator car, and to produce a control signal indicating to the controller the detected sway, wherein the controller is further configured to compare the detected away to a first predetermined limit and is further configured to slow down or stop the movement of the elevator car in response to the detected sway reaching the first predetermined limit, wherein the controller is further configured to accelerate or start up the elevator car in response to the detected sway being dampened below the first predetermined limit, wherein the controller is further configured to determine sway amplitude of the rope based on the detected sway, and wherein the first predetermined limit is chargeable.

* * * * *